US009314898B2

(12) United States Patent
Kazuno

(10) Patent No.: US 9,314,898 B2
(45) Date of Patent: Apr. 19, 2016

(54) POLISHING PAD

(75) Inventor: Atsushi Kazuno, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 307 days.

(21) Appl. No.: 13/636,299

(22) PCT Filed: Mar. 3, 2011

(86) PCT No.: PCT/JP2011/054859

§ 371 (c)(1),
(2), (4) Date: Sep. 20, 2012

(87) PCT Pub. No.: WO2011/118355

PCT Pub. Date: Sep. 29, 2011

(65) Prior Publication Data

US 2013/0012106 A1 Jan. 10, 2013

(30) Foreign Application Priority Data

Mar. 24, 2010 (JP) ..... 2010-068225

(51) Int. Cl.
*B24D 11/00* (2006.01)
*B24B 37/24* (2012.01)

(52) U.S. Cl.
CPC ..... *B24B 37/24* (2013.01)

(58) Field of Classification Search
CPC ..... B24B 37/24; B24D 3/26; B24D 11/00–11/08; B24D 3/32
See application file for complete search history.

(56) References Cited

U.S. PATENT DOCUMENTS

| | | | | |
|---|---|---|---|---|
| 6,998,166 | B2 * | 2/2006 | Prasad | 428/141 |
| 2004/0048559 | A1 * | 3/2004 | Park et al. | 451/288 |
| 2005/0276967 | A1 * | 12/2005 | Prasad | 428/314.8 |
| 2006/0276109 | A1 * | 12/2006 | Roy et al. | 451/41 |
| 2007/0173187 | A1 | 7/2007 | Park et al. | |
| 2008/0207100 | A1 * | 8/2008 | Roy et al. | 451/529 |
| 2009/0148687 | A1 | 6/2009 | Hirose et al. | |
| 2011/0151240 | A1 | 6/2011 | Hirose et al. | |

FOREIGN PATENT DOCUMENTS

| | | |
|---|---|---|
| JP | 2002-176017 | 6/2002 |
| JP | 2003-209078 | 7/2003 |
| JP | 2004-537424 | 12/2004 |
| JP | 2006-142474 | 6/2006 |
| JP | 2007-245298 | 9/2007 |
| JP | 2007-245575 | 9/2007 |
| JP | 2009-226543 | 10/2009 |
| JP | 2009-291942 | 12/2009 |

OTHER PUBLICATIONS

Notification of First Office Action dated Apr. 8, 2014, directed to CN Application No. 201180011578.1; 14 pages.

(Continued)

*Primary Examiner* — Joseph J Hail
*Assistant Examiner* — Brian Keller
(74) *Attorney, Agent, or Firm* — Morrison & Foerster LLP

(57) ABSTRACT

An object of the present invention is to provide a polishing pad having high planarization property and capable of making it possible to suppress the occurrence of scratches. A polishing pad of the present invention has a polishing layer having oval cells each with a long axis inclined by 5° to 45° with respect to the direction of the thickness of the polishing layer.

2 Claims, 2 Drawing Sheets

(56) References Cited

OTHER PUBLICATIONS

Notice to Submit a Response dated Oct. 8, 2013, directed to Korean Patent Application No. 10-2012-7016388; 6 pages.

Search Report mailed Apr. 12, 2011, directed towards International Application No. PCT/JP2011/054859; 4 pages.

Notification of the Third Office Action mailed May 21, 2015, directed to Chinese Application No. 201180011578.1; 13 pages.

* cited by examiner

POLISHING PAD

REFERENCE TO RELATED APPLICATIONS

This application is a national stage application under 35 USC 371 of International Application No. PCT/JP2011/054859, filed Mar. 3, 2011, which claims the priority of Japanese Patent Application No. 2010-068225, filed Mar. 24, 2010, the entire contents of which are incorporated herein by reference.

FIELD OF THE INVENTION

The invention relates to a polishing pad capable of performing planarization materials requiring a high surface planarity such as optical materials including a lens and a reflective mirror, a silicon wafer, a glass substrate or an aluminum substrate for a hard disk and a product of general metal polishing with stability and a high polishing efficiency. A polishing pad of the invention is preferably employed, especially, in a planarization step of a silicon wafer or a device on which an oxide layer or a metal layer has been formed prior to further stacking an oxide layer or a metal layer thereon.

BACKGROUND OF THE INVENTION

Typical materials requiring surface flatness at high level include a single-crystal silicon disk called a silicon wafer for producing semiconductor integrated circuits (IC, LSI). The surface of the silicon wafer should be flattened highly accurately in a process of producing IC, LSI etc., in order to provide reliable semiconductor connections for various coatings used in manufacturing the circuits in each steps of stacking an oxide layer or metal layer thereon. In the step of polishing finish, a polishing pad is generally stuck on a rotatable supporting disk called a platen, while a workpiece such as a semiconductor wafer is stuck on a polishing head. By movement of the two, a relative speed is generated between the platen and the polishing head while polishing slurry having abrasive grains is continuously supplied to the polishing pad, to effect polishing processing.

As polishing characteristic of a polishing pad, it is requested that a material being polished is excellent in planarity and in-plane uniformity and a polishing rate is large. A planarity and in-plane uniformity of a material being polished can be improved to some extent with a polishing layer higher in an elastic modulus. On the other hand, a polishing rate can be improved by using a foam containing pores, thereby, increasing an amount of slurry to be retained.

Considering the development of next-generation devices, there is a demand for high-hardness polishing pads capable of further increasing planarity. In order to increase planarity, hard polishing pads may also be used. If such hard polishing pads are used, however, a problem may occur in which scratches (scars) are more likely to occur on the surface of the material being polished.

Patent Document 1 proposes that for the purpose of preventing variations in life or polishing performance, a polishing plastic foam sheet should have elongated cells aligned in the in-plane direction of the sheet.

Patent Document 2 proposes that for the purpose of reducing variations in thickness and increasing polishing performance, a polishing pad should include a foamed material and have a plurality of pores in the surface part to be in contact with an object to be polished, wherein variations in thickness should be within ±15 μm, the pores should be uniformly distributed in the surface part, and the pores should have a ratio of the maximum diameter to the minimum diameter of 1.0 to 1.2.

Patent Document 3 proposes that for the purpose of increasing planarization property and in-plane uniformity, a polishing pad should include a polishing layer having closed cells, wherein the closed cells should include oval cells, and in the cross-section of the polishing layer, the oval cells should have a ratio (L/S) of average long axis length L to average short axis length S of 1.1 to 5.

Patent Document 4 discloses a laminated sheet including a base sheet and a polyurethane foam layer, wherein the polyurethane foam layer has oval cells each with a long axis parallel to the direction of the thickness of the polyurethane foam layer, and in the cross-section of the polyurethane foam layer, the oval cells have a ratio (L/S) of average long axis length L to average short axis length S of 1.5 to 3. It also discloses that the laminated sheet is a supporting sheet, a backing sheet, or a pressure-sensitive adhesive sheet.

Patent Document 5 proposes that for the purpose of increasing planarization property and in-plane uniformity and suppressing clogging and scratches, a polishing pad should include a closed void-containing polyester sheet containing polyester resin and incompatible thermoplastic resin, wherein the sheet should have a Shore D hardness of 50 or more, a compressibility ratio of 1.3 to 5.5%, and a compression recovery ratio of 50% or more, and the closed voids should have a flat shape with a long diameter of 5 to 30 μm, a short diameter of 1 to 4 μm, and a depth of 1 to 5 μm.

As mentioned above, considering the development of next-generation devices, there is a demand for polishing pads capable of further increasing planarity and making it possible to suppress scratches, but even using the above polishing pads, it has been difficult to satisfy the required planarization property and the scratch reduction at the same time.

Patent Document 1: JP-A-2003-209078
Patent Document 2: JP-A-2006-142474
Patent Document 3: JP-A-2007-245298
Patent Document 4: JP-A-2007-245575
Patent Document 5: JP-A-2009-291942

SUMMARY OF THE INVENTION

An object of the present invention is to provide a polishing pad having high planarization property and capable of making it possible to suppress the occurrence of scratches. Another object of the invention is to provide a semiconductor device-manufacturing method using such a polishing pad.

In order to solve the aforementioned problems, the present inventors intensively continued to study and, as a result, found out that the aforementioned objects can be attained by the following polishing pad, which resulted in completion of the invention.

Thus, the present invention is directed to a polishing pad including a polishing layer having oval cells each with a long axis inclined by 5° to 45° with respect to the direction of the thickness of the polishing layer.

When the cells in a polishing layer include oval cells (which are oval cells, but do not have to be perfectly symmetrical ovals), the polishing layer can have high elastic modulus without being increased in specific gravity, as compared with a conventional polishing layer having spherical cells. This makes it possible to increase the planarization property of the polishing pad. Unfortunately, it is difficult to suppress the occurrence of scratches only by forming oval cells in the polishing layer.

The present inventors have found that when the axes of oval cells in a polishing layer are inclined by 5° to 45° with respect to the direction of the thickness of the polishing layer, the planarization property can be increased, and the occurrence of scratches can be suppressed. Although the reason is not clear, it is conceivable that when the long axes of oval cells are inclined, the compression characteristics (S-S curve) of the polishing layer can have a microscopically-soft, low-distortion region so that the occurrence of scratches can be suppressed, and can also have a high-distortion region with macroscopically high elastic modulus so that planarization property can be increased.

The oval cells preferably have a ratio (L/S) of average long axis length L to average short axis length S of 1.1 to 3. If L/S is less than 1.1, it may be difficult to increase elastic modulus with no increase in specific gravity, which may make it difficult to increase planarization property. On the other hand, if L/S is more than 3, cell pockets may be deep, so that a reduction in the ability to refresh slurry may occur to reduce polishing rate and that clogging with polishing abrasive grains or polishing dust may be more likely to occur, which may tend to increase the occurrence of scratches on the object being polished.

The cells in the polishing layer may also include any other type of cells such as spherical cells or oval cells each with a long axis parallel to the direction of the thickness of the polishing layer. To fully achieve the desired effect, it is preferred that the ratio of the number of the oval cells each with a long axis inclined by 5° to 45° with respect to the direction of the thickness of the polishing layer to the number of all cells should be 50% or more. The cells in the polishing layer may be closed cells and/or open cells.

In the present invention, the polishing layer preferably includes a polyurethane resin foam.

Also, the invention relates to a method for manufacturing a semiconductor device, comprising a step of polishing a surface of a semiconductor wafer using the aforementioned polishing pad.

The polishing pad of the present invention, which may contain, in the polishing layer, a large number of oval cells each with a long axis inclined by 5° to 45° with respect to the direction of the thickness of the polishing layer, has high planarization property and makes it possible to effectively suppress the occurrence of scratches.

DETAILED DESCRIPTION OF THE INVENTION

Figure 1:
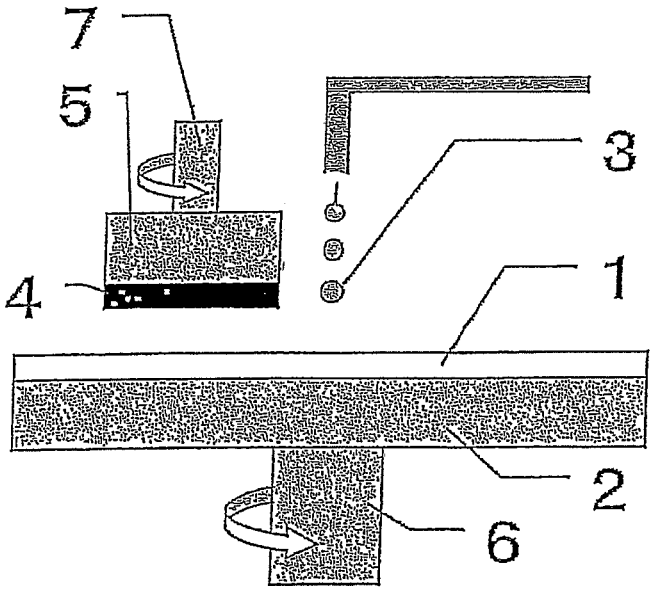
FIG. 1 is a schematic view showing an exemplary polishing apparatus used in chemical mechanical polishing (CMP).

The polishing pad of the invention may contain only the polishing layer, or may be a laminate of a polishing layer and other layer (e.g. cushion layer etc.). The material for forming the polishing layer is not particularly limited. For example, the material may be one or a mixture of two or more of polyurethane resin, polyester resin, polyamide resin, acrylic resin, polycarbonate resin, halogen-containing resin (e.g., polyvinyl chloride, polytetrafluoroethylene, or polyvinylidene fluoride), polystyrene, olefin resin (e.g., polyethylene or polypropylene), epoxy resin, photosensitive resin, and others. Polyurethane resin is a particularly preferred material for forming the polishing layer because it has high abrasion resistance and because urethane polymers with the desired physical properties can be easily obtained by varying the raw material composition. Hereinafter, a description is given on polyurethane resin as a typical material for forming the polishing layer.

The polyurethane resin is constituted of an isocyanate component, a polyol component (a high-molecular-weight polyol, a low-molecular-weight polyol and the like) and a chain extender.

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and cycloaliphatic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof.

As the isocyanate component, it is possible to use not only the above-described diisocyanate compounds but also multifunctional (trifunctional or more) polyisocyanates. As the multifunctional isocyanate compounds, a series of diisocyanate adduct compounds are commercially available as Desmodul-N (Bayer) and Duranate™ (Asahi Chemical Industry Co., Ltd.).

Among the aforementioned isocyanate components, it is preferable to use aromatic diisocyanate and cycloaliphatic diisocyanate jointly, and it is particularly preferable to use toluene diisocyanate and dicyclohexylmethane diisocyanate jointly.

As the high-molecular-weight polyol, a compound known in the field of polyurethane can be used without particular limitation. The high-molecular-weight polyol includes, for example, polyether polyols represented by polytetramethylene ether glycol and polyethylene glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, and polycarbonate polyols obtained by ester exchange reaction of a polyhydroxyl compound with aryl carbonate. These may be used singly or as a mixture of two or more thereof.

No limitation is imposed on a number-average molecular weight of a high-molecular-weight polyol but it is preferably in the range of from 500 to 2000 from the viewpoint of an elastic characteristic of an obtained polyurethane resin. If a number-average molecular weight thereof is less than 500, a polyurethane resin obtained by using the polyol does not have a sufficient elastic characteristic and easy to be fragile, and a polishing pad made from the polyurethane resin is excessively hard, which sometimes causes scratches to be generated on a surface of an object to be polished. Moreover, since a polishing pad is easy to be worn away, it is unpreferable from the viewpoint of a life of a polishing pad. On the other hand, if a number-average molecular weight thereof exceeds 2000, a polishing pad made from a polyurethane resin obtained from such a polyol is unpreferably soft to thereby disable a sufficiently satisfiable planarity to be earned.

Besides the above high-molecular-weight polyol described in the above as a polyol component, it is preferred to concomitantly use a low-molecular-weight polyol such as ethyleneglycol, 1,2-propylene glycol, 1,3-propylene glycol, 1,2-butanediol, 1,3-butanediol, 1,4-butanediol, 2,3-butanediol, 1,6-hexanediol, neopentylglyol, 1,4-cyclohexanedimethanol, 3-methyl-1,5-pentanediol, diethyleneglycol, triethyleneglycol, 1,4-bis(2-hydroxyethoxy)benzene, trimethylolpropane, glycerin, 1,2,6-hexanetriol, pentaerythritol, tetramethylol cyclohexane, methylglucoside, sorbitol, mannitol, dulcitol, sucrose, 2,2,6,6-tetrakis(hydroxymethyl)cyclohexanol, diethanolamine, N-methyldiethanolamine and triethanol amine. Low-molecular-weight polyamine such as ethylenediamine, tolylenediamine, diphenylmethanediamine, and diethylenetriamine may be used. Alcohol amine such as monoethanol amine, 2-(2-aminoethylamino) ethanol and monopropanol amine may be used. These may be used singly or in combination of two or more kinds. The content of the low-molecular-weight polyol, the low-molecular-weight polyamine, or other materials is not particularly limited, and may be appropriately determined depending on the properties required of the polishing pad (polishing layer) to be manufactured. Preferably, however, the content of the low-molecular-weight polyol, the low-molecular-weight polyamine, or the like is from 20 to 70% by mole based on the amount of all polyol components.

The content ratio between the high-molecular-weight polyol and the low-molecular-weight polyol in the polyol components can be determined depending on the properties required of the polishing layer to be produced from these materials.

In the case where a polyurethane resin is produced by means of a prepolymer method, a chain extender is used in curing of a prepolymer. A chain extender is an organic compound having at least two active hydrogen groups and examples of the active hydrogen group include: a hydroxyl group, a primary or secondary amino group, a thiol group (SH) and the like. Concrete examples of the chain extender include: polyamines such as 4,4'-methylenebis(o-chloroaniline) (MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, polytetramethylene oxide-di-p-aminobenzoate, 4,4'-diamino-3,3',5,5'-tetraethyldiphenylmethane, 4,4'-diamino-3,3'-diisopropyl-5.5'-dimethyldiphenylmethane, 4,4'-diamino-3,3',5,5'-tetraisopropyldiphenylmethane, 1,2-bis(2-aminophenylthio) ethane, 4,4'-diamino-3,3'-diethyl-5.5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; the low-molecular-weight polyol; and the low-molecular-weight polyamine. The chain extenders described above may be used either alone or in mixture of two kinds or more.

A ratio between an isocyanate component, a polyol component and a chain extender in the invention can be altered in various ways according to molecular weights thereof, desired physical properties of a polishing pad and the like. In order to obtain a polishing pad with desired polishing characteristics, a ratio of the number of isocyanate groups in an isocyanate component relative to a total number of active hydrogen groups (hydroxyl groups+amino groups) in a polyol component and a chain extender is preferably in the range of from 0.80 to 1.20 and more preferably in the range of from 0.99 to 1.15. When the number of isocyanate groups is outside the aforementioned range, there is a tendency that curing deficiency is caused, required specific gravity and hardness are not obtained, and polishing property is deteriorated.

A polyurethane resin can be produced by applying a melting method, a solution method or a known polymerization technique, among which preferable is a melting method, consideration being given to a cost, a working environment and the like.

Manufacture of a polyurethane resin is enabled by means of either a prepolymer method or a one shot method, of which preferable is a prepolymer method in which an isocyanate-terminated prepolymer is synthesized from an isocyanate component and a polyol component in advance, with which a chain extender is reacted since physical properties of an obtained polyurethane resin is excellent.

Note that an isocyanate-terminated prepolymer with a molecular weight of the order in the range of from 800 to 5000 is preferable because of excellency in workability and physical properties.

Manufacture of the polyurethane resin is to mix the first component containing an isocyanate group containing compound and the second component containing an active hydrogen group containing compound to thereby cure the reaction product. In the prepolymer method, an isocyanate-terminated prepolymer serves as an isocyanate group containing compound and a chain extender serves as an active hydrogen group containing compound. In the one shot method, an isocyanate component serves as an isocyanate group containing compound, and a chain extender and a polyol component combined serves as an active hydrogen containing compound.

A polyurethane resin foam as a material for forming the polishing layer of the present invention can be produced by a mechanical foaming method, a chemical foaming method, or any other method. If necessary, a method of adding hollow beads may also be used in combination with these methods.

Particularly, a mechanical foaming method using a silicone-based surfactant which is a copolymer of polyalkylsiloxane and polyether is preferable. As such the silicone-based surfactant, SH-192, SH-193, L5340 (manufactured by TORAY Dow Corning Silicone Co., Ltd.) etc. are exemplified as a suitable compound.

Various additives may be mixed; such as a stabilizer including an antioxidant, a lubricant, a pigment, a filler, an antistatic agent and others.

Hereinafter, a description is given of an exemplary method of producing a polyurethane resin foam that is used to form the polishing layer of the present invention and contains oval cells with their long axes inclined by 5° to 45° with respect to the direction of the thickness of the polishing layer. A method of producing such a polyurethane resin foam includes the steps described below.

1) a foaming step of preparing a bubble dispersion liquid of an isocyanate-terminated prepolymer (first component), wherein a silicone-based surfactant is added into an isocyanate-terminated prepolymer, which is agitated in the presence of a non-reactive gas to thereby disperse the non-reactive gas into the prepolymer as fine bubbles and obtain a bubble dispersion liquid. In a case where the prepolymer is solid at an ordinary temperature, the prepolymer is preheated to a proper temperature and used in a molten state.

2) a curing agent (chain extender) mixing step, wherein a chain extender (second component) is added into the bubble dispersion liquid, which is agitated to thereby obtain a foaming reaction liquid.

3) a casting Step, wherein the foaming reaction liquid is injected into a mold, and the mold is then clamped.

4) a curing Step, wherein the foaming reaction liquid injected into the mold is heated to be reacted and cured, the state is held by compressing or decompressing the inside of the mold until the liquid does not flow.

The non-reactive gas used for forming fine bubbles is preferably not combustible, and is specifically nitrogen, oxygen, a carbon dioxide gas, a rare gas such as helium and argon, and a mixed gas thereof, and the air dried to remove water is most preferable in respect of cost.

As a stirrer for dispersing the silicone-based surfactant-containing first component to form fine bubbles with the non-reactive gas, known stirrers can be used without particular limitation, and examples thereof include a homogenizer, a dissolver, a twin-screw planetary mixer etc. The shape of a stirring blade of the stirrer is not particularly limited either, but a whipper-type stirring blade is preferably used to form fine bubbles.

In a preferable mode, different stirrers are used in stirring for forming a bubble dispersion liquid in the stirring step and in stirring for mixing an added chain extender in the mixing step, respectively. In particular, stirring in the mixing step may not be stirring for forming bubbles, and a stirrer not generating large bubbles is preferably used. Such a stirrer is preferably a planetary mixer. The same stirrer may be used in the stirring step and the mixing step, and stirring conditions such as revolution rate of the stirring blade are preferably regulated as necessary.

As described above, it is necessary to perform a different operation from a conventional mechanical foaming method in the casting step and the curing step in order to produce the polyurethane resin foam containing oval cells. In detail, the following operation is performed.

1) Case 1

In the casting step, about 50 volume % of a foaming reaction liquid is injected into a mold of which one side or an opposite side is movable, and the upper surface of the mold is then covered with an upper lid to clamp the mold. It is preferable that vent holes for discharging an excessive foaming reaction liquid when the mold is compressed are formed in the upper lid of the mold. Thereafter, while the foaming reaction liquid is heated to be reacted and cured in the curing step, the side of the mold is moved to compress the mold, and the state is held until the composition does not flow. The composition is preferably compressed to 50 to 95% of the original horizontal width, and more preferably 80 to 90%. The composition is preferably compressed so that the excessive foaming reaction liquid is sufficiently discharged from the vent holes. In this case, the long axis of each of the oval cells is roughly perpendicular to the moving direction of the side surface of the mold.

2) Case 2

In the casting step, about 50 volume % of a foaming reaction liquid is injected into a mold, and the upper surface of the mold is then covered with an upper lid to clamp the mold. It is preferable that vent holes for discharging the excessive foaming reaction liquid when the mold is compressed are formed in at least one side surface of the mold. Thereafter, while the foaming reaction liquid is heated to be reacted and cured in the curing step, the upper lid and/or lower surface of the mold is moved to compress the mold, and the state is held until the composition does not flow. The composition is preferably compressed to 50 to 98% of the original height, and more preferably 85 to 95%. The composition is preferably compressed so that the excessive foaming reaction liquid is sufficiently discharged from the vent holes. In this case, the long axis of each of the oval cells is roughly perpendicular to the moving direction of the upper lid or lower surface of the mold.

3) Case 3

In the casting step, a foaming reaction liquid is injected in an amount capable of forming a space into a mold, and the upper surface of the mold is then covered with an upper lid to clamp the mold. Holes for decompressing the inside of the mold are formed in the upper lid. Thereafter, while the foaming reaction liquid is heated to be reacted and cured in the curing step, the inside of the mold is decompressed, and the state is held until the mixed solution does not flow. The composition is preferably compressed to 90 to 30 kPa, and more preferably 90 to 70 kPa. In this case, the long axis of each of the oval cells is roughly parallel to the height direction of the mold.

4) Case 4

Predetermined amounts of water and a curing agent are added to a bubble dispersion liquid of an isocyanate-terminated prepolymer, and the mixture is stirred to give a foaming reaction liquid. The foaming reaction liquid is poured in an amount of 50% by volume or more into a mold being heated, and then the upper side of the mold is covered with an upper lid, which is followed by clamping of the mold. The upper lid has vent holes for discharging excess foaming reaction liquid. Subsequently, the curing step is performed in which the foaming reaction liquid is heated to undergo a curing reaction. In this process, carbon dioxide gas is produced by the reaction to increase the pressure in the mold, so that excess foaming reaction liquid is discharged from the vent holes. In this case, the long axes of oval cells are substantially parallel to the direction of the height of the mold.

The vent holes preferably have a size of about 1 to about 5 mmϕ, and for example, a mold of about 1,000 mm square preferably has about 6 to about 20 vent holes. Out of the above range, the raw material may tend to be lost in a large amount, or oval cells may tend to be difficult to obtain. In the cases 1 and 2, the timing at which compression is started is preferably the point when the viscosity of the foaming reaction liquid exceeds 10 Pa·s. For example, the viscosity of the foaming reaction liquid can be measured using Model TV-10H Viscometer (TOKI SANGYO CO., LTD.) with Rotor H5 (4 rpm in number of revolutions). Also in the case 3, the timing at which the pressure reduction is started may be the same as described above. In the case 4, the process may be used in combination with the compression or pressure reduction step.

In the method of producing the polyurethane resin foam, heating and post-curing of the foam block obtained until the dispersion lost fluidity are effective in improving the physical properties of the foam, and are extremely preferable.

In the production of the polyurethane resin foam, a known catalyst promoting polyurethane reaction, such as tertiary amine-based catalysts, may be used. The type and amount of the catalyst added are determined in consideration of flow time in casting in a predetermined mold after the mixing step.

Figure 2:
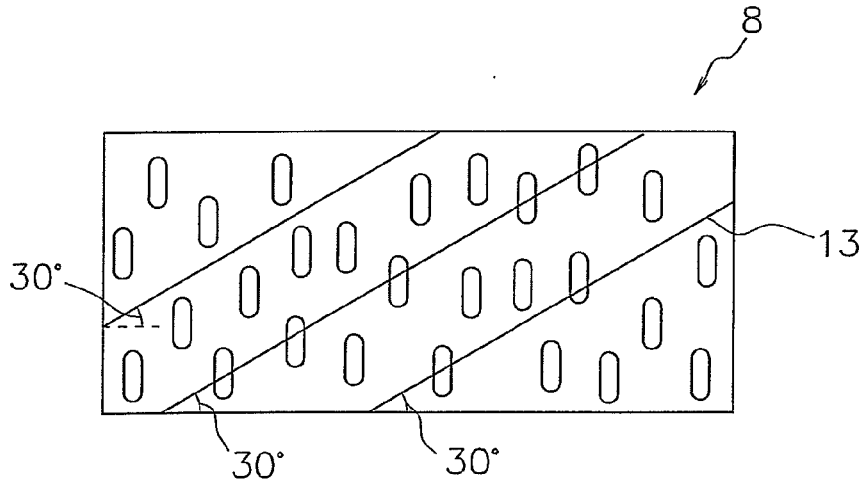
FIG. 2 is a schematic view showing the cross-section of a polyurethane resin foam block.
Figure 3:
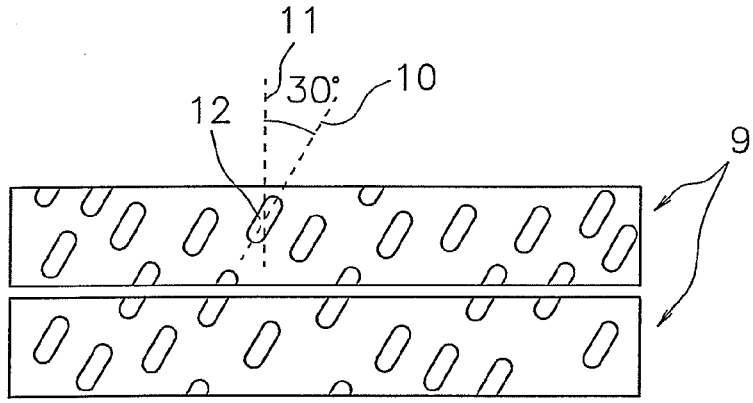
FIG. 3 is a schematic view showing the cross-section of a polyurethane resin foam sheet obtained by cutting the polyurethane resin foam block.

In the present invention, then, the resultant polyurethane resin foam block should be cut at an angle of 5° to 45° with a shave- or hand saw-type slicer or the like so that oval cells each with a long axis inclined at an angle of 5° to 45° with respect to the direction of the thickness of the polishing layer can be formed. The angle of inclination is preferably from 10° to 45°, more preferably from 30° to 45°. FIG. 2 is a schematic diagram showing the cross-section of a polyurethane resin foam block. FIG. 3 is a schematic diagram showing the cross-section of a polyurethane resin foam sheet obtained by cutting the polyurethane resin foam block. For example, the polyurethane resin foam block 8 is cut at an angle of 30° with respect to the plane of the block 8 so that a polyurethane resin foam sheet 9 can be formed having oval cells 12 each with a long axis 10 inclined by 30° with respect to the direction 11 of the thickness of the sheet. When the cutting angle is adjusted between 5° to 45° as described above, a polyurethane resin foam sheet can be formed having oval cells each with a long axis oriented and inclined at an angle of 5° to 45° toward a constant direction.

The oval cells preferably have a ratio (L/S) of average long axis length (L) to average short axis length (S) of 1.1 to 3, more preferably 1.3 to 2.5, in particular, preferably 1.5 to 2.

The oval cells also preferably have an average long axis length of 30 to 200 μm and an average short axis length of 25 to 65 μm. If they depart from the ranges, the polishing rate may tend to be low, or the planarity of the material being polished (wafer) may tend to be low.

The polyurethane resin foam sheet may also contain any other type of cells such as spherical cells or oval cells with their long axes parallel to the direction of the thickness of the sheet. To fully achieve the desired effect, the ratio of the number of oval cells each with a long axis inclined by 5° to 45° with respect to the direction of the thickness of the sheet to the number of all cells is preferably 50% or more, more preferably 60% or more, in particular, preferably 80% or more. The percentage of the number of the oval cells can be controlled within the desired range by controlling the degree of compression of the mold, the degree of reduction in the pressure in the mold, or the amount of water to be added.

Preferably, the polyurethane resin foam sheet has a specific gravity ranging from 0.3 to 0.88. When the specific gravity is less than 0.3, the surface strength of the polishing pad (polishing layer) decreases, so that the planarity of the wafer tends to decrease. When the specific gravity is larger than 0.88, the cell number on the surface of the polishing pad decreases, so that the polishing rate tends to decrease despite excellent planarity.

Preferably, the polyurethane resin foam sheet has a hardness measured by ASKER D hardness meter, ranging from 45 to 65 degrees. When the ASKER D hardness is less than 45 degrees, the planarity of the wafer decreases, while when the hardness is more than 65 degrees, the uniformity of the wafer tends to decrease despite excellent planarity.

A polishing surface of the polishing layer of the polyurethane resin foam sheet, which comes into contact with an object to be polished has a asperity structure provided for retaining and refreshing a slurry. A polishing layer made of a foam has a number of openings in the polishing surface, and has a function of retaining and refreshing a slurry. By forming an asperity structure on the polishing surface, it is possible to conduct retention and refreshment of the slurry more efficiently, and to prevent the object to be polished from breaking due to adsorption of the material to be polished. The shape of the asperity structure is not particularly limited insofar as it is able to retain and refresh a slurry, and for example, XY grating groove, concentric ring groove, through-hole, non-through-hole, polygonal column, circular cylinder, spiral groove, eccentric ring groove, radial groove, and combination thereof can be recited. These asperity structures generally have regularity, however, groove pitch, groove width, groove depth and the like may be varied by a certain range for achieving desired retention and refreshment of slurry.

A preparation method of the asperity structure is not particularly limited. Examples of preparation method include the method of machine cutting using a jig such as a bite of predetermined size, the preparation method of pouring a resin into a mold having a predetermined surface shape, and allowing the resin to harden, the preparation method of pressing a resin with a pressing plate having a predetermined surface shape, the preparation method of using photolithography, the preparation method using printing techniques, and the preparation method based on laser beam using carbon dioxide gas laser or the like.

The thickness of the polishing layer is generally, but is not limited to, about 0.8 to 4 mm, and preferably 1.0 to 2.5 μm.

The range of the thickness of the polishing layer is preferably 100 μm or less. When the range of the thickness is higher than 100 μm, large undulation is caused to generate portions different in a contacting state with an object of polishing, thus adversely influencing polishing characteristics. To solve the range of the thickness of the polishing layer, the surface of the polishing layer is dressed generally in an initial stage of polishing by a dresser having abrasive grains of diamond deposited or fused thereon, but the polishing layer outside of the range described above requires a longer dressing time to reduce the efficiency of production.

As a method of suppressing the range of thickness, there is also a method of buffing the surface of the polishing layer having a predetermined thickness. Buffing is conducted preferably stepwise by using polishing sheets different in grain size.

A polishing pad of the invention may also be a laminate of a polishing layer and a cushion sheet adhered to each other.

The cushion sheet (cushion layer) compensates for characteristics of the polishing layer. The cushion layer is required for satisfying both planarity and uniformity which are in a tradeoff relationship in CMP. Planarity refers to flatness of a pattern region upon polishing an object of polishing having fine unevenness generated upon pattern formation, and uniformity refers to the uniformity of the whole of an object of polishing. Planarity is improved by the characteristics of the polishing layer, while uniformity is improved by the characteristics of the cushion layer. The cushion layer used in the polishing pad of the present invention is preferably softer than the polishing layer.

The material forming the cushion sheet is not particularly limited, and examples of such material include a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, polymer resin foam such as polyurethane foam and polyethylene foam, rubber resin such as butadiene rubber and isoprene rubber, and photosensitive resin.

Means for adhering the polishing layer to the cushion sheet include: for example, a method in which a double sided tape is sandwiched between the polishing layer and the cushion sheet, followed by pressing.

The double sided tape is of a common construction in which adhesive layers are provided on both surfaces of a substrate such as a nonwoven fabric or a film. It is preferable to use a film as a substrate with consideration given to prevention of permeation of a slurry into a cushion sheet. A composition of an adhesive layer is, for example, of a rubber-based adhesive, an acrylic-based adhesive or the like. An acrylic-based adhesive is preferable because of less of a content of metal ions, to which consideration is given. Since a polishing layer and a cushion sheet is sometimes different in composition from each other, different compositions are adopted in respective adhesive layers of double sided tape to thereby also enable adhesive forces of the respective adhesive layers to be adjusted to proper values.

A polishing pad of the invention may be provided with a double sided tape on the surface of the pad adhered to a platen. As the double sided tape, a tape of a common construction can be used in which adhesive layers are, as described above, provided on both surfaces of a substrate. As the substrate, for example, a nonwoven fabric or a film is used. Preferably used is a film as a substrate since separation from the platen is necessary after the use of a polishing pad. As a composition of an adhesive layer, for example, a rubber-based adhesive or an acrylic-based adhesive is exemplified. Preferable is an acrylic-based adhesive because of less of metal ions in content to which consideration is given.

A semiconductor device is fabricated after operation in a step of polishing a surface of a semiconductor wafer with a polishing pad. The term, a semiconductor wafer, generally means a silicon wafer on which a wiring metal and an oxide layer are stacked. No specific limitation is imposed on a polishing method of a semiconductor wafer or a polishing apparatus, and polishing is performed with a polishing apparatus equipped, as shown in FIG. 1, with a polishing platen 2 supporting a polishing pad (a polishing layer) 1, a polishing head 5 holding a semiconductor wafer 4, a backing material for applying a uniform pressure against the wafer and a supply mechanism of a polishing agent 3. The polishing pad 1 is mounted on the polishing platen 2 by adhering the pad to the platen with a double sided tape. The polishing platen 2 and the polishing head 5 are disposed so that the polishing pad 1 and the semiconductor wafer 4 supported or held by them oppositely face each other and provided with respective rotary shafts 6 and 7. A pressure mechanism for pressing the semiconductor wafer 4 to the polishing pad 1 is installed on the polishing head 5 side. During polishing, the semiconductor wafer 4 is polished by being pressed against the polishing pad 1 while the polishing platen 2 and the polishing head 5 are rotated and a slurry is fed. No specific limitation is placed on a flow rate of the slurry, a polishing load, a polishing platen rotation number and a wafer rotation number, which are properly adjusted.

Protrusions on the surface of the semiconductor wafer 4 are thereby removed and polished flatly. Thereafter, a semiconductor device is produced therefrom through dicing, bonding, packaging etc. The semiconductor device is used in an arithmetic processor, a memory etc.

EXAMPLES

Description will be given of the invention with examples, while the invention is not limited to description in the examples.

[Measurement and Evaluation Methods]

(Measurement of Average Major Axis and Average Minor Axis of Oval Cells)

Using a microtome cutter, the prepared polyurethane resin foam sheet was cut parallel to the long axes of oval cells into a measurement sample. The section of each of the measurement samples was photographed with a scanning electron microscope (manufactured by Hitachi Science Systems Co. with a model number of S-3500N) at a magnification of ×100. The major axis and minor axis of each of oval cells in an arbitrary area were measured with an image analyzing soft (manufactured by MITANI Corp. with a trade name WINROOF), and the average major axis L, average minor axis S and L/S were calculated from the measured values.

(Determination of the Percentage of the Number of Oval Cells Each with a Long Axis Inclined by 5° to 45° with Respect To the Direction of the Thickness of the Sheet)

Using a microtome cutter, the prepared polyurethane resin foam sheet was cut in the direction of its thickness into a measurement sample. The cross-section (see FIG. 3) of the measurement sample was photographed using a scanning electron microscope (S-3500N, manufactured by Hitachi Science Systems, Ltd.) at a magnification of 100 times. Subsequently, image analysis software (WinROOF, manufactured by MITANI CORPORATION) was used to count all cells and oval cells each with a long axis inclined by 5° to 45° with respect to the direction of the thickness of the sheet in a certain area, and the ratio (%) of the number of the oval cells to the number of all cells was calculated.

(Measurement of Specific Gravity)

Determined according to JIS Z8807-1976. A manufactured polyurethane resin foam sheet cut out in the form of a strip of 4 cm×8.5 cm (thickness: arbitrary) was used as a sample for measurement of specific gravity and left for 16 hours in an environment of a temperature of 23±2° C. and a humidity of 50%±5%. Measurement was conducted by using a specific gravity hydrometer (manufactured by Sartorius Co., Ltd).

(Measurement of Hardness)

Measurement is conducted according to JIS K6253-1997. A manufactured polyurethane resin foam sheet cut out in a size of 2 cm×2 cm (thickness: arbitrary) was used as a sample for measurement of hardness and left for 16 hours in an environment of a temperature of 23±2° C. and a humidity of 50%±5%. At the time of measurement, samples were stuck on one another to a thickness of 6 mm or more. A hardness meter (Asker D hardness meter, manufactured by Kobunshi Keiki Co., Ltd.) was used to measure hardness.

(Evaluation of Polishing Characteristic)

Polishing characteristic was evaluated using the prepared polishing pad with the use of SPP600S (available from Okamoto Machine Tool Works, Ltd.) as a polishing apparatus. For measurement of thickness of an oxidized membrane, an interference film thickness measuring instrument (available from OTSUKA ELECTRONICS Co., Ltd.) was used. As for polishing condition, silica slurry (SS12 manufactured by Cabot) was added at a flow rate of 150 ml/min during polishing. Polishing loading was 1.5 psi, the number of revolutions of the polishing platen was 120 rpm, and the number of revolutions of the wafer was 120 rpm. Using a dresser (Type M100, Asahi Diamond Industrial Co., Ltd.), the surface of the polishing layer was dressed for 20 seconds at predetermined intervals under the conditions of a dressing load of 50 g/cm$^2$, a number of dresser revolutions of 15 rpm, and a number of platen revolutions of 30 rpm.

In addition, for assessing planarity, a thermally oxidized membrane was deposited 0.5 μm on a 8 inch silicon wafer, patterning of L/S (line and space)=25 μm/5 μm and L/S=5 μm/25 μm was performed, and an oxidized membrane (TEOS) was further deposited 1 μm to prepare a wafer with a pattern at an initial step of 0.5 μm. This wafer was polished under the aforementioned polishing condition, and an abrasion amount of a bottom part of a 25 μm space was measured at a global step of 2000 Å or smaller, thereby, planarity was assessed. As a value of an abrasion amount is smaller, planarity can be said to be excellent.

(Evaluation of Scratches)

Four 8-inch dummy wafers were polished under the above conditions, and then a wafer with a 10,000-Å thick thermal oxide film deposited thereon was polished for 1 minute under the above conditions. Subsequently, a defect evaluation system manufactured by KLA-Tencor Corporation (Surf scan SP1) was used to determine how many scratches of 0.2 μm or more were there on the polished wafer.

Example 1

To a reaction vessel were added 100 parts by weight of an isocyanate-terminated prepolymer (ADIPRENE L-325, manufactured by UNIROYAL CHEMICAL COMPANY, INC.) and 3 parts by weight of a silicone surfactant (SH-192, manufactured by Dow Corning Toray Silicone Co., Ltd.) and mixed. The mixture was adjusted to 80° C., reduced in pressure, and degassed. Subsequently, the mixture was vigorously stirred with a stirring blade at a number of revolutions of 900 rpm for about 4 minutes in such a manner that air bubbles were incorporated into the reaction system. To the resulting mixture were added 22 parts by weight of 4,4'-methylenebis (o-chloroaniline) IHARACUAMINE-MT, manufactured by IHARA CHEMICAL INDUSTRY CO., LTD.), which had been previously melted at 120° C., and 0.3 parts by weight of water. The liquid mixture was stirred for about 1 minute and then poured into a mold (800 mm wide, 1,300 mm long, and 35 mm high) until the liquid level reached 33 mm. Subsequently, the upper side of the mold was covered with an upper lid having ten 3-mmϕ vent holes, and the mold was clamped. Subsequently, while the liquid mixture was heated at 60° C. to undergo a curing reaction, the side of the mold was moved so that the width of the mold was reduced from 800 mm to 700 mm, at the time when the viscosity of the liquid mixture exceeded 10 Pa·s, and the resulting state was maintained until the liquid mixture lost its fluidity. Excess liquid mixture was discharged from the vent holes. Subsequently, the mixture was subjected to post-curing at 110° C. for 6 hours, so that a polyurethane resin foam block was obtained.

Using a hand saw-type slicer (manufactured by Fecken-Kirfel GmbH & Co.), the polyurethane resin foam block was sliced at an angle of 30° with respect to the plane of the block as shown in FIG. 2, so that a polyurethane resin foam sheet (0.83 in specific gravity, 53 degrees in D hardness) was obtained. Subsequently, using a buffing machine (manufactured by AMITEC Corporation), the surface of the sheet was buffed until its thickness reached 1.27 mm, so that a sheet with adjusted thickness accuracy was obtained. The buffing was performed using first a belt sander with 120-mesh abrasive grains (manufactured by RIKEN CORUNDUM CO., LTD.), then a belt sander with 240-mesh abrasive grains (manufactured by RIKEN CORUNDUM CO., LTD.), and finally a belt sander with 400-mesh abrasive grains (manufactured by RIKEN CORUNDUM CO., LTD.). The buffed sheet was stamped into a 600-mm diameter piece, and the surface of the piece was subjected to 1.6-mmϕ punching, so that a polishing sheet was obtained. Using a laminator, a double-sided adhesive tape (DOUBLE TACK TAPE, manufactured by SEKISUI CHEMICAL CO. LTD.) was bonded to the opposite surface of the polishing sheet from the punched surface. The surface of a corona-treated cushion sheet (Toray-pef manufactured by Toray Industries, Inc., polyethylene foam, 0.8 μm in thickness) was also buffed, and the buffed sheet was bonded to the double-sided adhesive tape using a laminator. A double-sided adhesive tape was further bonded to the other side of the cushion sheet using a laminator, so that a polishing pad was obtained.

Example 2

A polishing pad was prepared by the same method as in Example 1, except that the block was sliced at an angle of 5° with respect to the plane of the block when the polyurethane resin foam sheet was formed.

Example 3

A polishing pad was prepared by the same method as in Example 1, except that the block was sliced at an angle of 45° with respect to the plane of the block when the polyurethane resin foam sheet was formed.

Comparative Example 1

A polishing pad was prepared by the same method as in Example 1, except that the block was sliced horizontally with respect to the plane of the block when the polyurethane resin foam sheet was formed.

Comparative Example 2

A polishing pad was prepared by the same method as in Example 1, except that the block was sliced at an angle of 50° with respect to the plane of the block when the polyurethane resin foam sheet was formed.

Comparative Example 3

A urethane composition with dispersed air bubbles was prepared by the same method as in Example 1, except that water was not added. The urethane composition with dispersed air bubbles was poured into a mold (800 mm wide, 1,300 mm long, and 35 mm high). Subsequently, the composition was heated at 60° C. to undergo a curing reaction. The composition was then subjected to post-curing at 110° C. for 6 hours, so that a polyurethane resin foam block was obtained. Subsequently, a polishing pad was prepared by the same method as in Example 1. The prepared polyurethane resin foam sheet had a specific gravity of 0.82 and a D hardness of 52 degrees.

TABLE 1

| | Cell shape | Cutting angle | Average long axis length L (μm) | Average short axis length S (μm) | L/S | Percentage (%) of the number of oval cells each with long axis inclined by 5°-45° with respect to the direction of the thickness of the polishing layer | Abrasion amount (Å) | Scratches (/wafer) |
|---|---|---|---|---|---|---|---|---|
| Example 1 | Oval cells | 30° | 92 | 51 | 1.8 | 84 | 1600 | 2 |
| Example 2 | Oval cells | 5° | 91 | 48 | 1.9 | 83 | 1550 | 8 |
| Example 3 | Oval cells | 45° | 88 | 49 | 1.8 | 85 | 1800 | 1 |
| Comparative Example 1 | Oval cells | 0° | 87 | 52 | 1.7 | 0 | 1500 | 25 |
| Comparative Example 2 | Oval cells | 50° | 93 | 55 | 1.7 | 0 | 2500 | 11 |
| Comparative Example 3 | Spherical cells | — | — | — | — | 0 | 2300 | 10 |

A polishing pad of the invention is capable of performing planarization materials requiring a high surface planarity such as optical materials including a lens and a reflective mirror, a silicon wafer, a glass substrate or an aluminum substrate for a hard disk and a product of general metal polishing with stability and a high polishing efficiency. A polishing pad of the invention is preferably employed, especially, in a planarization step of a silicon wafer or a device on which an oxide layer or a metal layer has been formed prior to further stacking an oxide layer or a metal layer thereon.

In the drawings, reference numeral 1 represents a polishing pad (polishing layer), 2 a polishing platen, 3 a polishing agent (slurry), 4 an object being polished (semiconductor wafer), 5 a support (polishing head), 6 and 7 each a rotating shaft, 8 a polyurethane resin foam block, 9 a polyurethane resin foam sheet, 10 a long axis, 11 the direction of the thickness of the sheet, 12 oval cells, and 13 cutting sites.

The invention claimed is:

1. A polishing pad, comprising a polishing layer having oval cells each with a long axis inclined by 30° to 45° with respect to the direction of the thickness of the polishing layer, at least some of the oval cells being closed so as to contain a gas, wherein the oval cells have a ratio (L/S) of average long axis length L to average short axis length S of 1.5 to 3, and the ratio of the number of the oval cells to the number of all cells is at least 80%.

2. The polishing pad according to claim 1, wherein the polishing layer comprises a polyurethane resin foam.

* * * * *